US005669094A

United States Patent [19]

Swanson

[11] Patent Number: 5,669,094

[45] Date of Patent: Sep. 23, 1997

[54] MATTRESS WITH VISCO-ELASTIC, TEMPERATURE SENSITIVE TOP LAYER

[76] Inventor: Larry Sven Swanson, 2166 Sandy Shore Dr. SE., Kentwood, Mich. 49508

[21] Appl. No.: 607,832

[22] Filed: Feb. 27, 1996

[51] Int. Cl.[6] ..... A47C 27/15

[52] U.S. Cl. ..... 5/740; 5/953

[58] Field of Search ..... 5/740, 953, 655.9, 5/724, 690, 653

[56] References Cited

U.S. PATENT DOCUMENTS

| | | | |
|---|---|---|---|
| 3,939,508 | 2/1976 | Hall et al. | 5/740 |
| 4,580,301 | 4/1986 | Ludman et al. | 5/727 |
| 5,022,111 | 6/1991 | Fenner, Sr. | 5/740 |
| 5,179,742 | 1/1993 | Oberle | 5/727 |

FOREIGN PATENT DOCUMENTS

| | | | |
|---|---|---|---|
| 2479673 | 10/1981 | France | 5/740 |
| 1445561 | 8/1976 | United Kingdom . | |
| 2044091 | 3/1980 | United Kingdom . | |
| 2244000 | 11/1991 | United Kingdom | 5/740 |
| 2290256 | 12/1995 | United Kingdom | 5/740 |
| 8102384 | 9/1981 | WIPO | 5/727 |

OTHER PUBLICATIONS

TEMPUR–PEDIC® Swedish Mattress and Pillow Product Brochure, Lexington, KY.

Technical Data Sheet TDS–13, E–A–R Specialty Composites, Indianapolis, IN.

*Primary Examiner*—Alexander Grosz

*Attorney, Agent, or Firm*—Brooks & Kushman P.C.

[57] ABSTRACT

A mattress comprises a top layer of visco-elastic polyurethane foam having a low rebound property and which is temperature sensitive and having a thickness of approximately ½ to 1½ inches; a second layer of latex foam having vertical bores and a thickness of approximately 2 to 4 inches; and a third layer of resilient material having a thickness of approximately 3 to 7 inches.

7 Claims, 3 Drawing Sheets

MATTRESS WITH VISCO-ELASTIC, TEMPERATURE SENSITIVE TOP LAYER

TECHNICAL FIELD

This invention is directed to a mattress.

BACKGROUND ART

When a person is lying on a planar mattress surface, the pressure exerted on the surface at certain areas of the body is normally greater than at others. For instance, the greatest areas of pressure are normally in the regions of the shoulders and hips.

Accordingly, mattresses are designed to yield in such a way as to minimize the concentration of such pressures. In the case of medical patients confined to a bed for periods of time, the minimization of such pressure is especially desirable to avoid bedsores. However, a desirable mattress should also, at the same time, conform to the body shape of the user and provide resilient support to allow the spine and joints to rest in their natural positions. This minimizes the stresses otherwise placed on the muscles and nerves and any resulting pain and stiffness.

Various types of foam have been used as a mattress material in an attempt to provide the proper mix of yielding and supportive properties. For example, Tempur-Pedic® mattresses have two foam layers. The top 3-inch layer is a visco-elastic open-celled polyurethane foam having low rebound properties and temperature-softening behavior. The bottom 5-inch layer is a polyurethane foam.

However, Tempur-Pedic® mattresses are relatively expensive because of the relatively thick top layer of visco-elastic open-celled polyurethane foam, used in conjunction with the underlying layer of polyurethane foam, which is needed to provide the characteristics of that mattress.

SUMMARY OF THE INVENTION

An object of the present invention is to provide a relatively inexpensive mattress which provides superior cushioning and support characteristics; to minimize pressure points and the resulting stress on muscles and nerves, and to allow the spine and joints of a body to rest in a natural position.

In carrying out the above objects, features, and advantages, the present invention is a mattress comprising a top layer of polyurethane foam having a low rebound property and a second layer of material having a relative independent support property.

In an alternative embodiment, the mattress comprises a top layer of polyurethane foam having a low rebound property, a second layer of material having a relative independent support property, and a third layer of resilient material.

In both embodiments, the top layer of polyurethane foam having a low rebound property, used in conjunction with the underlying layer of material having a relative independent support property, serves to maximize the positive characteristics of each material resulting in a relatively inexpensive mattress which provides superior support and comfort characteristics.

These objects, and other objects, features, and advantages of the present invention, will be readily appreciated by one of ordinary skill in the art from the following detailed description of the best mode for carrying out the invention when taken in connection with the accompanying drawings.

BRIEF DESCRIPTION OF THE DRAWINGS

While embodiments of the invention are illustrated, the particular embodiments shown should not be construed to limit the claims. It is anticipated that various changes and modifications may be made without departing from the scope of this invention.

BEST MODE CARRYING OUT THE INVENTION

Figure 1:
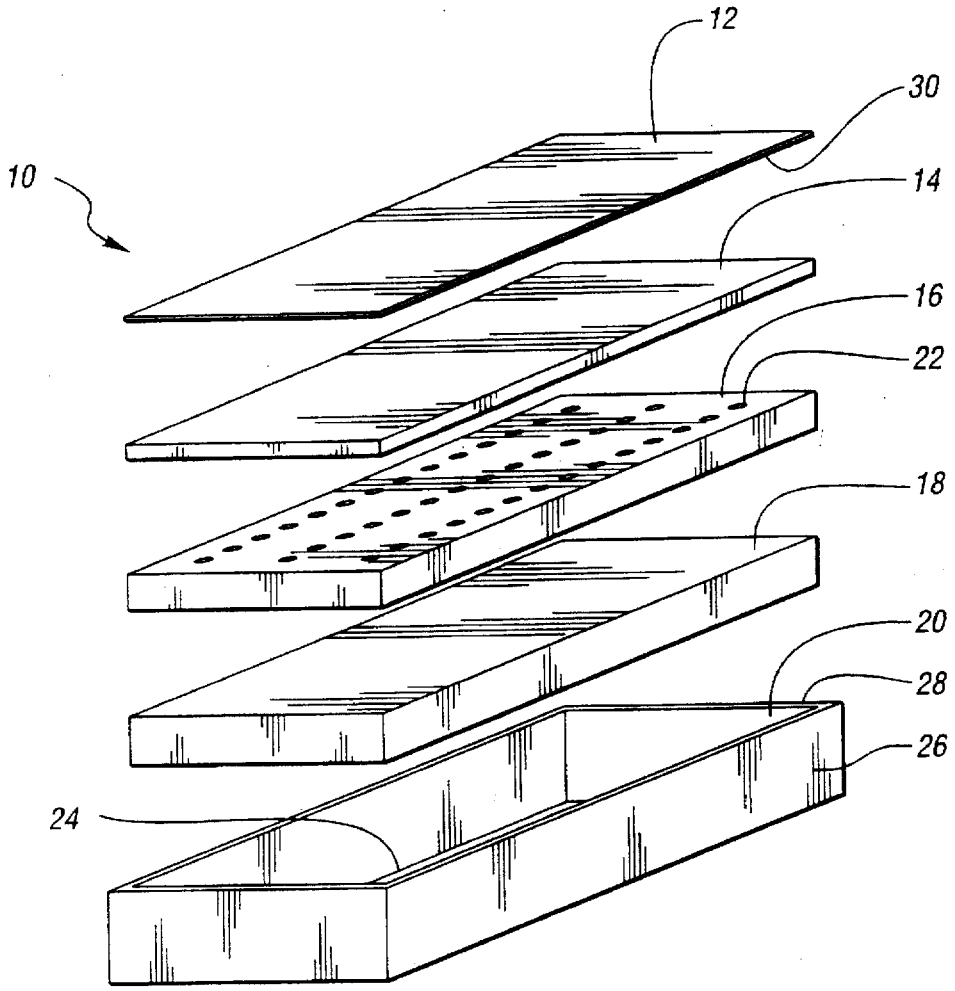
FIG. 1 is an exploded perspective view of one embodiment of the improved mattress of the present invention.
Figure 2:
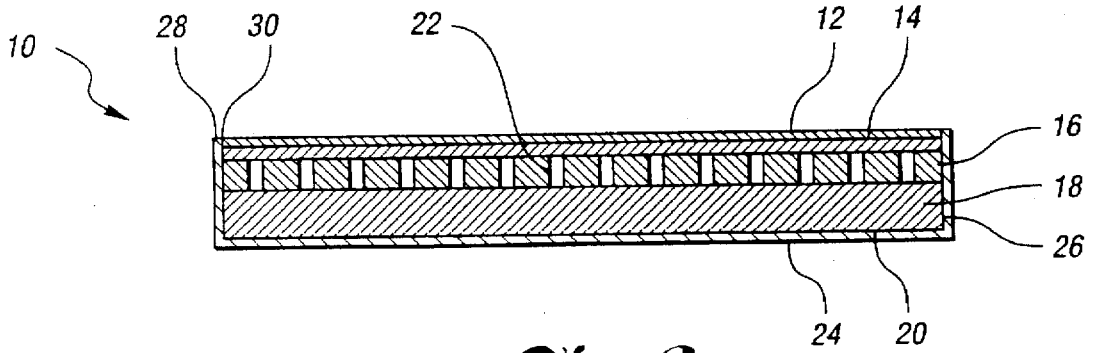
FIG. 2 is an elevational side view of the internal core of the mattress shown in FIG. 1.

As shown in FIGS. 1 and 2, one embodiment of the present invention comprises a mattress 10 having a top cover portion 12, a top layer 14, a second layer 16, a third layer 18, and a bottom cover portion 20.

The top layer 14 is preferably made of visco-elastic open-celled polyurethane foam. The top layer of foam preferably has a low rebound property. In other words, when the top layer 14 is depressed one half inch or more, the top layer 14 should rebound or recover slowly, at least over approximately two or more seconds, to its originally shape. It is also desirable that the visco-elastic open-celled polyurethane foam forming the top layer 14 be temperature sensitive. In other words, when the top layer 14 comes into contact with a warm surface, such as skin, the top layer 14 will soften, thereby allowing the top layer to mold to the user's body and provide a more uniform pressure distribution across the body. It is desirable that the hardness of the top layer 14, measured using test material ASTM 02240, Shore 00, 15 second impact, change by approximately three or more between 4° C. and 10° C.

Polyurethane foams having both the lower rebound properties and temperature sensitivity would include Confor® which is sold by E-A-R Specialty Composites Corporation, a division of Cabot Safety Corporation, located at 7911 Zionsville Road, Indianapolis, Ind. While different Confor® foams may be used depending on the mattress application, one type of Confor® found especially suitable is CF-40 Yellow having a nominal density of 5.8 lb/ft$^3$. The specifications regarding Confor® and the temperature sensitivities of Confor®, are set forth in a Technical Data Sheet TDS-13 distributed by E-A-R Specialty Composites Corporation. For instance, CF-40 Yellow has a nominal density of 5.8 lb/ft$^3$ using test method ASTM D3574; a ball rebound of 0.9% using test method ASTM D3574; an impact absorption of 75 G using test method ASTM F355, modified 11 lb. missile, 3.4 m/sec., 24" drop, "G" Max; a hardness of 79 at 4° C. and 70 at 10° C. using test method ASTM D2240, Shore 00, 15 second impact; a compression set (% deflection from original height) of 0.6% when compressed 25%, and 2.4% when compressed 50%, using test method ASTM D3574, 70° C.×22 hours; a compression set (% deflection from original height) of 0.2% when using test method ASTM D1667, at 22° C., 24 hour recovery, when compressed 25%; and indentation force deflection values of 34 lbf at 10° C., 4 lbf at 21° C., and 3 lbf at 38° C., using test method ASTM D3574, test B1, 25% deflection.

Thus, a reference in this patent to Confor® type materials refers to Confor® itself or any other polyurethane foam offering similar characteristics.

The second layer 16 can be made from any suitable material offering the property of relative independent support i.e. the minimization of a "hammock effect." In other words, it is desirable that when a portion of the second layer 16 is depressed, that the resultant depression of adjacent connected material in the second layer 16 be minimized to some extent. Because a bed should adjust to the body, and not the other way around, it is desirable if portions of the mattress adjust independently in order to allow the mattress to mold to the body and avoid point contact or pressure areas. While not required, it is also preferable that the second layer 16 have a higher or approximately equal indentation load deflection value than the top layer 14; i.e. it is preferred that the second layer be approximately equal in firmness or firmer.

Commercially available latex foam products, including those having a grid of bores, such as the cylindrical bores 22 shown in FIGS. 1 and 2, have been found suitable. If bores 22 are used, not only do the bores 22 assist in providing relative independent support, the bores 22 also provide air passages which allow the mattress to breathe and minimize moisture buildup within the mattress 10*e*. One specific type of latex foam material found suitable is Pincore which is made using the Talalay process and has a grid-like pattern of bores. Pincore is sold by Latex Foam Products Incorporated located at 20 West Main Street, Ansonia, Conn. 06401.

Latex foam inherently provides a greater independent support characteristic relative to polyurethane or urethane foams. This difference is attributable to the compositional differences between the materials and is reflected, at least in part, in the typical load deflection curves for each type of material. A load-deflection curve is typically a graph of the force in lbs. required to indent a flat disk of 50 sq. in. (8" diameter) into the foam or other material being tested for any given percentage of deflection.

Latex foam is typically characterized by having a more gradual slope in the lower portion of the curve, that is in the range of 5–10% deflection, which typically becomes steeper in the higher portion of the curve, that in the range of 50–70% of deflection. Urethane foams, on the other hand, typically have a steeper initial portion of the curve, in the range of 5–10% deflection, which typically decreases in the higher deflection ranges.

Figure 5:
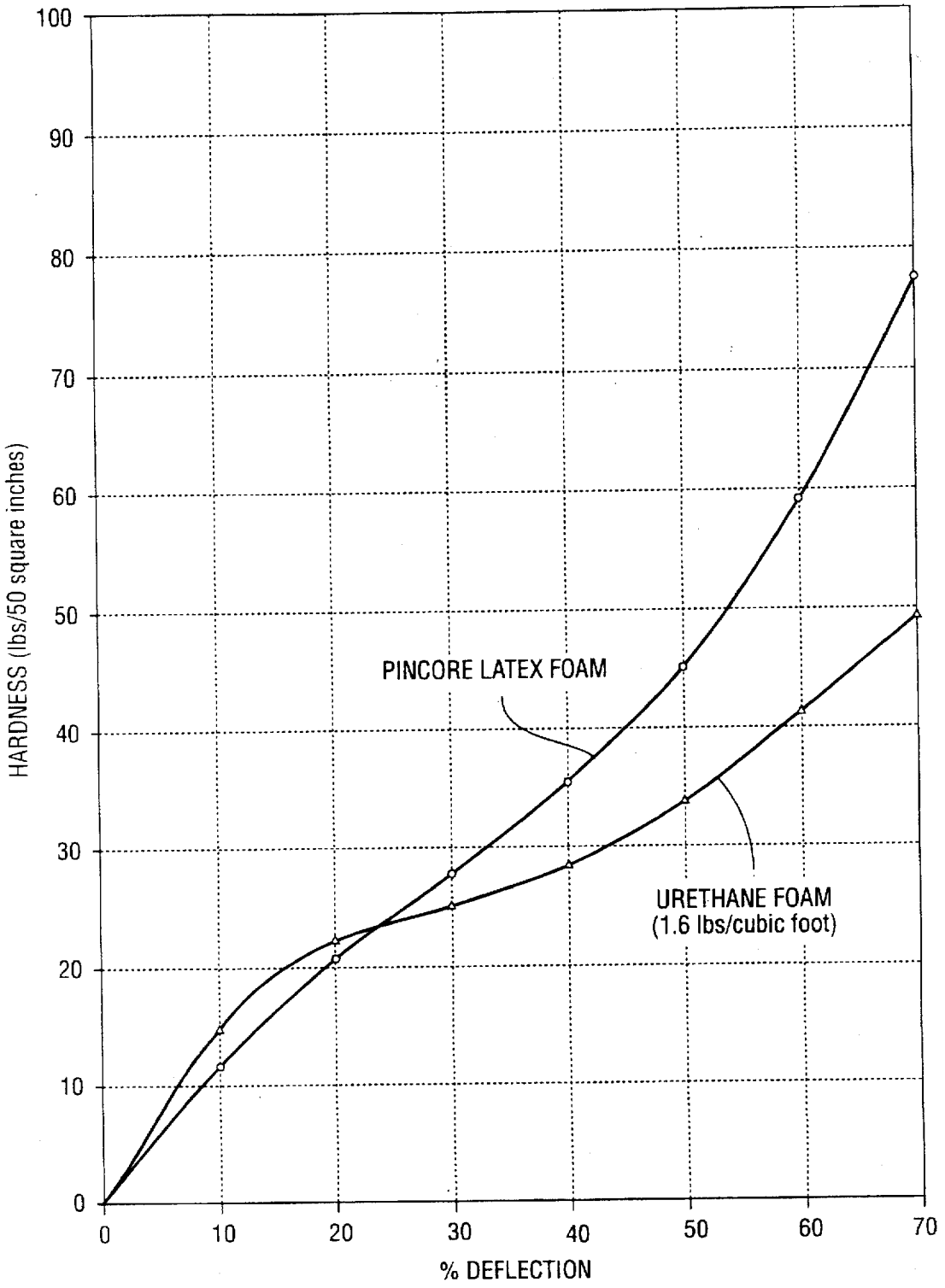
FIG. 5 is an illustrative example of load deflection curves for Pincore latex foam as compared to urethane foam.

This difference between latex and urethane foams is illustrated in FIG. 5. FIG. 5 illustrates typical load deflection curves for a 4" medium firm layer of Pincore latex foam versus a 4" layer of urethane foam having a density of 1.6 lbs./ft$^3$.

Thus, while Pincore latex foam has a softer initial feel, it resists deflection at heavier loads. This contributes, at least in part and in addition to the grid-like pattern of bores, to Pincore latex foam offering greater independent support relative to a urethane foam. Accordingly, it is desirable that the second layer 16 have a load deflection curve which has a more gradual slope in the 5–10% deflection range than a typical urethane foam.

While a variety of such foam materials may be used, depending on the mattress application, one type of Pincore latex foam found especially suitable is a firm Pincore latex foam.

The third layer 18 can be made from any suitable material offering firm yet resilient support. High density open-cell urethane foam has been found to be suitable. While not required, it is preferable if the third layer 18 has a higher indentation load deflection value than the second layer 16. In other words, the second layer 16 is softer than the third layer 18.

The top layer 14, second layer 16, and third layer 18, can be secured to each other in any conventional manner, including by way of commercially available adhesives suitable for such use such as SIMALFA® which may be procured through ALFA Adhesives, 2 Oakwood Ave., N. Haledon, N.J. 07608.

In a preferred embodiment, it has been found that a top layer 14 having a thickness of approximately 1-inch, a second layer 16 have a thickness of approximately 3-inch, and a third layer 18 having a thickness of approximately 5-inch, provides superior support and comfort qualities. While these dimensions have been found suitable, a top layer having a thickness of approximately ½ to 1½ inches, a second layer having a thickness of approximately 2–4 inches, and a bottom layer having a thickness of approximately 3–7 inches should also provide superior support and comfort characteristics.

The top cover portion 12 and bottom cover portion 20 can be made from any suitable conventional materials. The bottom cover portion 20 has a rectangular bottom wall 24 an four upstanding sidewalls 26, as well as a zipper 28 which extends the full perimeter of the bottom cover portion 20 along the upper edge of the four sidewalls 26. The top cover portion 12 likewise has a zipper 30 along the perimeter which can be releasably coupled to the zipper 28 on the bottom cover portion 20.

Because the relative independent support property of the second layer 16 serves to maximize the conforming nature of the top layer 14, the mattress of this invention minimizes pressure concentrations between the mattress surface and a user. Furthermore, the thickness of the relatively expensive top layer 14 material needed to provide the desired characteristics is minimized. The result is a relatively inexpensive mattress which provides superior support and comfort capabilities.

Figure 3:
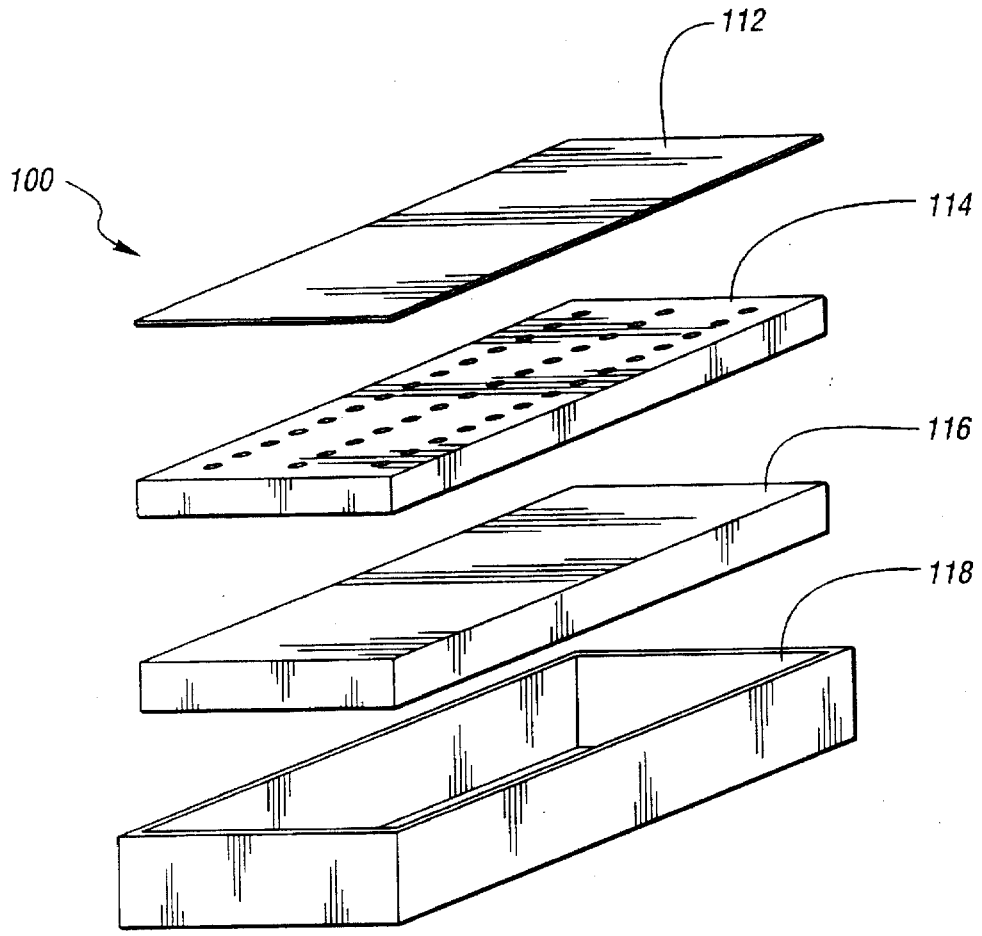
FIG. 3 is an exploded perspective view of an alternative embodiment of the improved mattress of the present invention.
Figure 4:
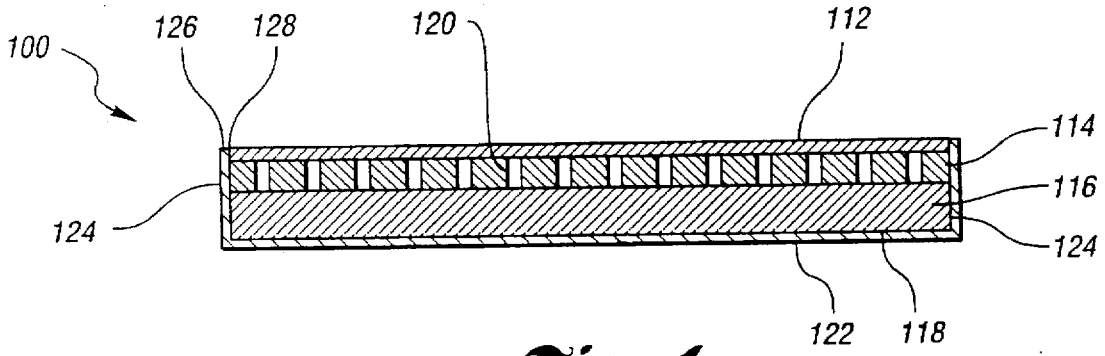
FIG. 4 is an elevational side view of the internal core of the mattress shown in FIG. 3.

As shown in FIGS. 3 and 4, a second embodiment of the present invention comprises a mattress 100 having a top cover portion 112, a top layer 114, a second layer 116, and a bottom cover portion 118.

Like the top layer 14 of the first embodiment shown in FIGS. 1 and 2, the top layer 114 of this second embodiment is preferably made of a visco-elastic open-celled polyurethane foam having a low rebound property and temperature sensitivity.

Like the second layer 16 of the first embodiment, the second layer 116 of this second embodiment is preferably made from any suitable material offering the property of relative independent support. Similar to the embodiment shown in FIGS. 1 and 2, it is preferable that the second layer 116 have a grid of bores, such as the cylindrical bores 120 shown in FIGS. 3 and 4. It is also preferable that the second layer have a higher or approximately equal indentation load deflection value than the top layer 114.

The top layer 114 and the second layer 116 may be secured to each other in any conventional manner, including by way of commercially available adhesives suitable for such use.

In a preferred embodiment, it has been found that a top layer 114 having a thickness of approximately 3" and a second layer 116 having a thickness of approximately 6", provides superior support and comfort qualities. While these dimensions are suitable, a top layer having a thickness of approximately 2–4" and a bottom layer having a thickness of approximately 5–7" should also provide superior support and comfort characteristics.

Like the first embodiment shown in FIGS. 1 and 2, the top cover portion 112 and the bottom cover portion 118 can be made from any suitable conventional materials. The bottom cover portion 118 has a rectangular bottom wall 122 and four upstanding side walls 124, as well as a zipper 126 which extends the full perimeter of the bottom cover portion 118 along the upper edge of the four side walls 124. The top cover portion 112 likewise has a zipper 128 along the perimeter which can be releasably coupled to the zipper 126 on the bottom cover portion 118.

Like the first embodiment shown in FIGS. 1 and 2, because the relative independent support property of the third layer 116 serves to maximize the conforming nature of the top layer 114, the mattress of this invention minimizes pressure concentrations between the mattress surface and a user. As a result, the thickness of the relatively expensive top layer 114 material needed to provide the desired characteristics is minimized. The result is a relatively inexpensive mattress which provides superior support and comfort capabilities.

While particular embodiments of the invention have been illustrated and described, it will be obvious to those skilled in the art that various changes and modifications may be made without departing from the invention. It is intended that the following claims cover all such modifications and all equivalents that fall within the true spirit and scope of this invention.

What is claimed is:

1. A mattress comprising:

a top layer of visco-elastic polyurethane foam having a low rebound property and which is temperature sensitive and having a thickness of approximately ½ of 1½ inches;

a second layer of latex foam having vertical bores and a thickness of approximately 2 to 4 inches; and a third layer of resilient material having a thickness of approximately 3 to 7 inches.

2. The mattress of claim 1, wherein the vertical bores are cylindrical.

3. The mattress of claim 1, wherein the third layer is made from high density open-celled polyurethane foam.

4. The mattress of claim 1, further including a cover which encloses the top layer, second layer and third layer.

5. The mattress Of claim 1, wherein the second layer has a higher indentation load deflection value than the top layer and third layer has a higher indentation load deflection value than the second layer.

6. A mattress comprising:

a top layer of visco-elastic polyurethane foam having a low rebound property and which is temperature sensitive and having a thickness of approximately 1 to 1½ inches;

a second layer of latex foam having vertical bores and a thickness of approximately 2 to 4 inches;

a third layer of high density open-celled polyurethane foam having a thickness of approximately 3 to 7 inches; and a cover which encloses the top layer, second layer, and third layer.

7. The mattress of claim 6, wherein the vertical bores are cylindrical.

* * * * *